US006690906B2

(12) United States Patent
Tanaka et al.

(10) Patent No.: US 6,690,906 B2
(45) Date of Patent: Feb. 10, 2004

(54) FIXING APPARATUS AND IMAGE FORMING APPARATUS

(75) Inventors: Hajime Tanaka, Tokyo (JP); Masami Maruko, Tokyo (JP); Hidetoshi Katayanagi, Tokyo (JP); Toshiki Hayami, Tokyo (JP)

(73) Assignee: Konica Minolta Technosearch Co., Ltd., Tokyo (JP)

( * ) Notice: Subject to any disclaimer, the term of this patent is extended or adjusted under 35 U.S.C. 154(b) by 0 days.

(21) Appl. No.: 10/012,105

(22) Filed: Nov. 13, 2001

(65) Prior Publication Data

US 2002/0090237 A1 Jul. 11, 2002

(30) Foreign Application Priority Data

Nov. 17, 2000 (JP) ..... 2000-350765

(51) Int. Cl.[7] ..... G03G 15/20
(52) U.S. Cl. ..... 399/330; 219/216
(58) Field of Search ..... 399/328, 330, 399/331, 333; 219/216; 492/56

(56) References Cited

U.S. PATENT DOCUMENTS 4,580,033 A * 4/1986 Sakurai ..... 219/216
4,842,944 A * 6/1989 Kuge et al. ..... 428/451
RE33,770 E * 12/1991 Torino et al. ..... 399/331
5,450,183 A * 9/1995 O'Leary ..... 399/321
5,481,349 A * 1/1996 Satoh et al. ..... 399/328
5,640,662 A * 6/1997 Sugimoto et al. ..... 399/333
5,724,638 A * 3/1998 Isogai et al. ..... 399/333
6,393,249 B1 * 5/2002 Aslam et al. ..... 399/333

FOREIGN PATENT DOCUMENTS

JP 11167296 A * 6/1999 ..... G03G/15/20
JP 11202658 A * 7/1999 ..... G03G/15/20

* cited by examiner

*Primary Examiner*—Robert Beatty
(74) *Attorney, Agent, or Firm*—Squire, Sanders & Dempsey, L.L.P.

(57) ABSTRACT

A fixing apparatus for fixing a toner image formed on a transfer sheet comprised of rotatable heating member having a thermo-conductive base material, a heat-resistive resilient layer provided to cover the outer surface of the thermo-conductive base material, and a heat-resistive releasing layer provided to cover the heat resistive resilient layer; and a rotatable pressure member to nip and transport the transfer sheet cooperating with the rotatable heating member, for fusing the toner image on the transfer sheet; wherein, hardness of the surface of heat-resistive releasing member measure by a micro hardness meter is 55 to 75° and the surface roughness $R_z$ is 0.5–2.0 $\mu$m.

19 Claims, 4 Drawing Sheets

FIXING APPARATUS AND IMAGE FORMING APPARATUS

BACKGROUND OF THE INVENTION

The present invention relates to a fixing apparatus used for an image forming apparatus such as a copier, printer, or facsimile, and particularly to a fixing apparatus having a heat rotating body such as a heat roller or heat fixing belt, and a pressing rotating body which pressure-contacts with the heat rotating body, and to an image forming apparatus provided with the fixing apparatus.

Conventionally, in an image forming apparatus such as the copier, printer, or facsimile, in the fixing apparatus for heat-fixing process of a recorded material carrying a toner formed of heat-fusible resin, the heat roller system are frequently adopted.

The heat roller system fixing apparatus is composed of a metallic heat roller provided with a heat generation source such as a halogen heater therein, and an resilient pressure roller to pressure-contact with it, and when a recorded material such as paper sheet is passed through a fixing nip portion which is a pressure-contact portion of this pair of rollers, a toner image carried on the recorded material is heated and fixed.

In the fixing apparatus which is mounted in an electrophotographic system image forming apparatus to output a color image, a heat roller having an resilient layer such as a silicon rubber on the surface of a roller core bar is used.

When the heat roller is hard, the surface of the heat roller does not follow the undulation of the sheet or toner layer, and in a half tone image, the blackening manner is different depending on dots, and the image granularly appears, and in a solid portion, the uneven gloss appears, and the image quality is lowered. In a monochromatic image, the same image quality lowering is generated, but, because the line image is main, it is comparatively inconspicuous. Accordingly, for the improvement of the image quality of the color image, the fixing heat roller having an resilient layer is absolutely necessary.

In the image forming apparatus provided with the roller fixing type fixing apparatus composed of the heat roller whose heat conducting substrate (core bar) is covered by the resilient layer, and further which has a heat resistive releasing layer thereon, and the pressure roller. As the heat resistive releasing layer of the surface layer, fluorine resin, fluorine rubber, or silicon rubber is adopted. In the case of image forming apparatus which forms the image only on a single side of the sheet, it is necessary that the heat resistive releasing layer of the surface of the heat roller is selected under considering the image quality, the toner offset property, the wrapping property of the sheet around the heat roller, and the durability.

The heat resistive releasing layer of the conventional heating roller has high minute hardness, and prevent the generation of the roller flaws, and maintains the durability. However, when the minute hardness of the heat resistive releasing layer is increased, the deterioration of the fixed image is conspicuous, and not so good in the image quality. Further, when the minute hardness of the heat releasing layer is low, there is a trouble such as the generation of flows of the heat resistive releasing layer surface by a contact type temperature sensor or sheet separation claw.

For the hardness of the heat resistive releasing layer, the hardness (minute hardness) is regulated in Japanese Tokkai-2000-No. 75714, however, this regulates the minute hardness of the heat roller surface for the single side image formation onto the OHP sheet, and there is no solution of the problem in the case of the double side image formation as in the present invention.

Further, the heat roller described in Japanese Patent Tokkouhei No. 6-100876 is composed of 4 layer structure of a roller substrate, a silicon rubber layer, a composite layer formed of rubber and resin, and resin layer, and by the composite layer as an intermediate layer, the silicon rubber layer as the lower layer and the resin layer as the upper layer are strongly combined. For the heat roller formed of this 4 layer structure, there has been no regulation of the thickness or the hardness, and it can not serve for solving the problem at the double sides image formation as in the present invention.

The object of the present invention is to provide a fixing apparatus and an image forming apparatus which can solve the conventional problems described above.

SUMMARY OF THE INVENTION

The above described object is attained by the following structures.

(1) A fixing apparatus which heats and fixes a toner image formed on a transfer sheet by a heat rotating body in which a heat resistive resilient layer is covered on a heat conductive substrate and a heat resistive releasing layer is further formed thereon and which is heated by a heat source, and a pressure rotating body which pressure-contacts with the heat rotating body, wherein the minute hardness, measured by a micro hardness meter, of the heat resistive releasing layer is set to not lower than 55° and not larger than 75°.

(2) A fixing apparatus which heats and fixes a toner image formed on a transfer sheet by a heat rotating body in which a heat resistive resilient layer is covered on a heat conductive substrate and a heat resistive releasing layer is further formed thereon and which is heated by a heat source, and a pressure rotating body which pressure-contacts with the heat rotating body, wherein the toner image is formed by using a polymerization toner produced by a polymerization method, and the softening point of the polymerization toner is not higher than 125° C.

(3) An image forming apparatus which is characterized in that it is provided with the fixing apparatus described in (1) or (2), and an image forming means and a sheet conveying means.

DETAILED DESCRIPTION OF THE PREFERRED EMBODIMENT

Figure 1:
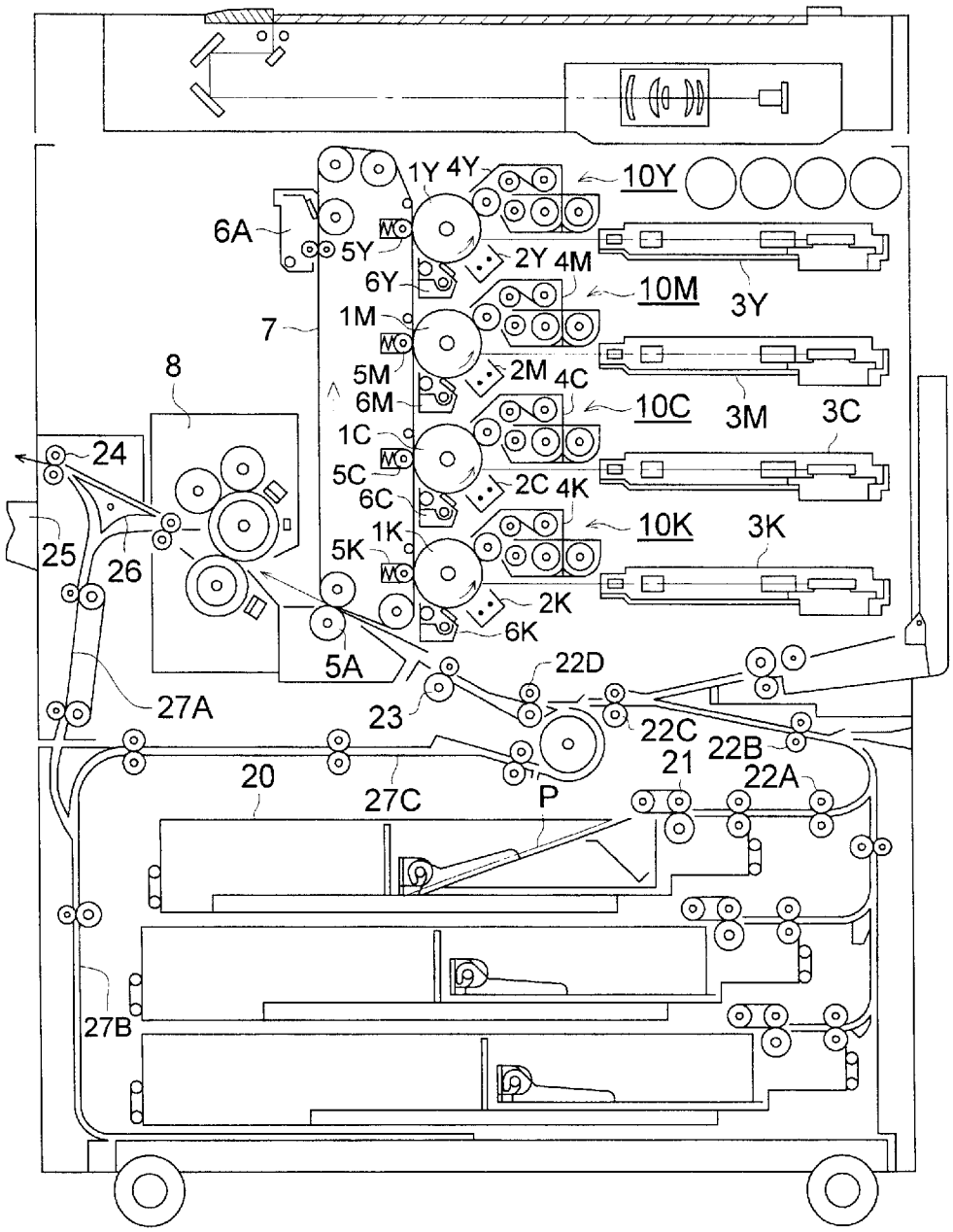
FIG. 1 is a sectional structural view of a color image forming apparatus showing an embodiment of an image forming apparatus provided with a fixing apparatus according to the present invention.

Referring to the drawings, embodiments of a fixing apparatus and an image forming apparatus of the present invention will be described below.

FIG. 1 is a sectional structural view of a color image forming apparatus showing an embodiment of an image forming apparatus provided with a fixing apparatus according to the present invention.

This color image forming apparatus is called a tandem type color image forming apparatus and comprises a plurality of image forming sections 10Y, 10M, 10C, and 10K, which are arranged in a train, and a semiconductive endless belt-like intermediate transfer body 7 which is wound around by a plurality of rollers and rotatably supported, and a sheet feed conveying means and a fixing apparatus 8.

The image forming section 10Y to form a yellow image has a charging means 2Y arranged around an image carrier (photoreceptor)1, exposure means 3Y, developing means 4Y, primary transfer means 5Y, and cleaning means 6Y. The image forming section 10M to form a magenta image has an image carrier (photoreceptor) 1M, charging means 2M, exposure means 3M, developing means 4M, primary transfer means 5M, and cleaning means 6M. The image forming section 10C to form a cyan image has an image carrier (photoreceptor) 1C, charging means 2C, exposure means 3C, developing means 4C, primary transfer means 5C, and cleaning means 6C. The image forming section 10K to form a black image has an image carrier (photoreceptor) 1K, charging means 2K, exposure means 3K, developing means 4K, primary transfer means 5K, and cleaning means 6K.

Each of color images formed by image forming sections 10Y, 10M, 10C, and 10K, are successively transferred onto the rotating intermediate transfer body 7 by the primary transfer means 5Y, 5M, 5C, and 5K, and a composite color image is formed. A transfer sheet (hereinafter, called sheet) P accommodated in a sheet feed cassette 20, is fed by a sheet fed means 21, and through a plurality of intermediate rollers 22A, 22B, 22C, 22D, and register roller 23, conveyed to a secondary transfer means 5A, and color images are collectively transferred onto the sheet P. The sheet P onto which the color image is transferred, is fixing processed by a fixing apparatus 8, and nipped by sheet delivery rollers 24 and stacked on a sheet delivery tray 25 outside the apparatus.

At the time of both side image formation, the sheet P delivered from the fixing apparatus 8 on whose first surface the image is formed, is branched from a sheet delivery path by a branch means 26, and passes through the lower reversal sheet passing path 27A, 27B, and 27C, and is joined at the intermediate roller 22D. The reversal-conveyed sheet P is conveyed to the secondary transfer means 5A through the register roller 23, and the color image is collectively transferred onto the second side of the sheet P. The sheet P onto which the color image is transferred, is fixing processed by the fixing apparatus 8, and nipped by the sheet delivery roller 24, and stacked on the delivery sheet tray 25 outside the apparatus.

On the one hand, after the color image is transferred onto the sheet by the secondary transfer means 5A, a residual toner on the intermediate transfer body 7 from which the sheet P is curvature-separated, is removed by the cleaning means 6A.

During the image formation processing, the primary transfer means 5K may always pressure contact with the photoreceptor 1K. The other primary transfer means 5Y, 5M, and 5C respectively pressure contact with corresponding photoreceptors 1Y, 1M, and 1C, only during the color image formation. The secondary transfer means 5A pressure contacts with the intermediate transfer body 7 only when the sheet P passes trough this place and the secondary transfer is conducted.

Figure 2:
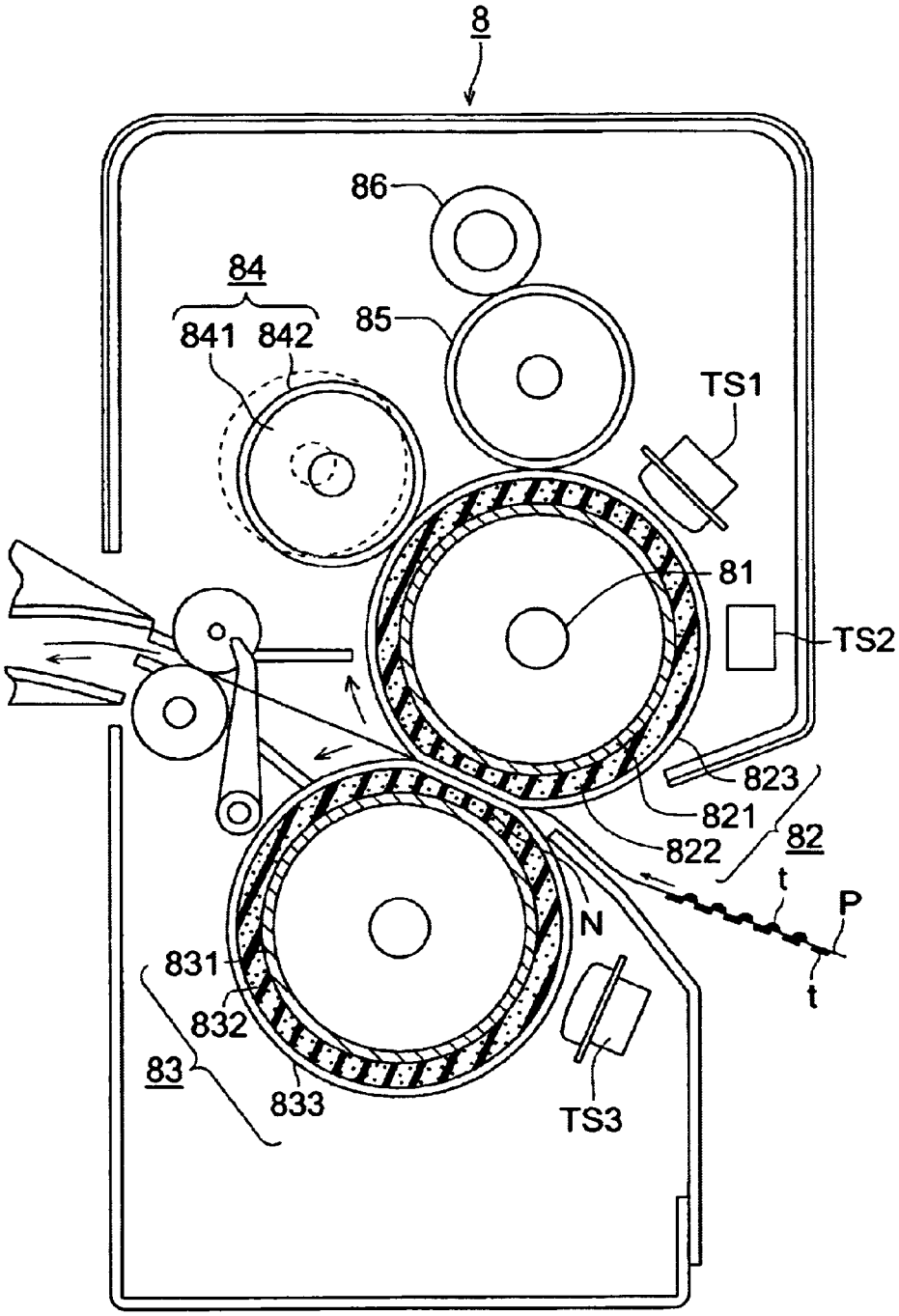
FIG. 2 is a sectional view showing an embodiment of the fixing apparatus of the present invention.

FIG. 2 is a sectional view showing an embodiment of the fixing apparatus of the present invention.

The fixing apparatus (roller fixing apparatus) 8 is composed of a heat source 81, heat roller (rotatable heat member) 82, and pressure roller (rotatable pressure member) 83. Around the heat roller 82, a cleaning roller 84, oil coating roller 85, cleaning roller 86 of the oil coating roller, non-contact type thermostat TS1 for abnormal temperature prevention, and non-contact type temperature detection sensor TS2 are arranged.

For the heat source 81, a halogen lamp, or an induction heating means is used. The heat roller 82 is structured by a heat conductive substrate (core bar) 821, heat resistive resilient layer (hereinafter, called resilient layer) 822 covering the outside of the heat conductive substrate 821, and heat resistive releasing layer (hereinafter, called releasing layer) 823 further covering the outside thereof.

The pressure roller 83 is structured, around the heat conductive substrate (core bar) 831, by the resilient layer 832 such as the silicon rubber, and covering layer 833 formed of fluorine resin further covering the outside thereof. A symbol N is a fixing nip portion at which the pressure roller 83 and the heat roller 82 pressure contact with each other.

The temperature sensor TS2 detects the surface temperature of the heat roller 82. By the detection signal of the temperature sensor TS2, a control means, not shown, controls the surface temperature of the heat roller 82 to a predetermined temperature.

When the sheet P is introduced into the fixing nip portion N at which the heat roller 82 and the pressure roller 83 pressure-contact with each other, the heat of the heat roller 82 heated by the heat source 81 is given to the sheet P and the toner image t on the sheet P is heated and fixed.

The heat roller 82 is composed of the heat conductive substrate 821, resilient layer 822, and releasing layer 823. As the cylindrical heat conductive substrate 821, aluminum material having the good heat conductivity (heat conductivity is 238 W/m·K) is mainly used, and non-magnetic stainless steel (heat conductivity is 15 W/m·K), Pyrex glass, sapphire ($Al_2O_3$), or ceramic material such as $CaF_2$ (heat conductivity is 1–2 W/m·K) is also used. The heat conductive substrate 821 has a predetermined mechanical strength, and the thickness (wall thickness) is 0.8–5 mm thick.

The resilient layer 822 is formed of, for example, synthetic rubber such as silicone rubber or fluorine rubber. Further, in order to correspond to the high increase of the speed of the image formation, a method by which powder of metallic oxide such as silica, alumina, magnesium oxide of 5–30 weight % is mixed in the synthetic rubber as a filler, and the heat conductivity is increased, is preferable, and the layer which is formed as an resilient layer whose heat conductivity is 0.2–2 W/m·K, is used. It is preferable that the mixed filler has the good conductivity. In such the manner, the electric resistance (volume resistivity) of the resilient layer 822 can be easily set to lower. The thickness (wall thickness) of the resilient layer 822 is 0.8–5 mm, and preferably, 1–3 mm thick.

In order to make the releasing property from the toner good, the releasing layer 823 in which a PFA (fluorine resin)

tube of 20–100 μm thick is covered around the outside (outer peripheral surface) of the resilient layer 822, or the fluorine resin (PFA or PTFE) paint is coated by 20–100 μm thickness, or silicon rubber or fluorine rubber of the layer thickness 20–500 μm is molded and whose heat conductivity is 0.3–1 W/m·K, is provided. The releasing layer 823 makes the releasing property from the toner good, and increases the durability of the resilient layer 822.

Another Embodiment of the Heat Roller

Figure 3:
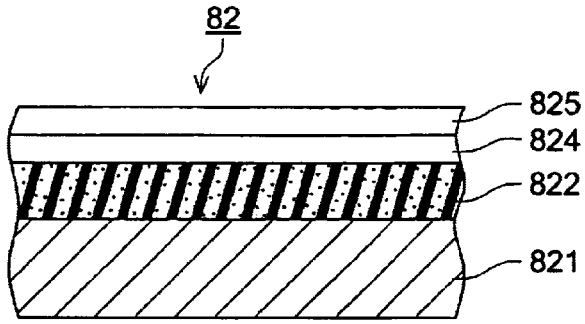
FIG. 3 is a layer structural view showing another embodiment of a heat roller and a pressure roller.

FIG. 3 is a layer structural view showing another embodiment of the heat roller 82 and the pressure roller 83. In this connection, in the reference numeral used in FIG. 3, a portion having the same function as in FIG. 2 is denoted by the same numeral. Further, the different point from FIG. 2 will be described.

The heat roller has 4 layer structure in which the resilient layer 822 is covered on the heat conductive substrate 821, and the composite layer 824 formed of rubber and resin is provided further thereon, and the resin layer 825 is formed further thereon.

The heat conductive substrate 821 and the resilient layer 822 are the same structures as the above description. The outer most resin layer 825 is formed of, for example, fluorine resin such as poly tetra fluoro ethylene (PTFE), and is a thin layer whose thickness is several 10 μm. The resin layer 825 makes the releasing property from the toner good in the same manner as the releasing layer 823, and increases the durability of the resilient layer 822.

The composite layer 824 of the lower layer of the resin layer 825 is formed by mixing the fluorine rubber and fluorine resin, and is a thin layer whose thickness is several 10 μm. The composite layer 824 is formed as the adhered layer of the resilient layer 822 and the resin layer 825, and when the heat roller 82 is rotated in pressure-contact with the pressure roller 83, it acts as a cushioning material of the resin layer 825, and prevents the crack of the resin layer 825 from being generated.

Pressure roller (refer to FIG. 2)

The pressure roller 83 as the lower cylindrical fixing member which is paired with the upper heat roller 82, is composed of the heat conductive substrate 831, resilient layer 832, and covering layer 833. The component members of the pressure roller 82 are formed in the almost same material, characteristic, and dimension as the component members of the heat roller 82.

For example, it is structured by the heat conductive substrate 831 using the aluminum material, and on the outer peripheral surface of the heat conductive substrate 831, for example, it is structured as a soft roller of the outer diameter of 25–50 mm, formed of a sponge-like resilient layer 832 which is formed of the thick wall rubber layer of the thickness (wall thickness) of 5–20 mm thick and whose rubber hardness is 10 Hs–40 Hs (JIS, A rubber hardness), by using the silicon rubber layer or fluorine rubber layer, or the foaming material of the silicon rubber. On the outside (outer peripheral surface) of the resilient layer 832, a covering layer 833 which is covered by the heat resistive fluorine resin tube such as PFA or PTFE having the releasing property, is formed. A high heat insulative resilient rubber roller is used for the lower pressure roller 83, and the diffusion of the heat from the upper side heat roller 82 to the lower side pressure roller 83 is prevented, and a wide nip width is secured. A plane-like fixing nip portion N is formed between the upper side heat roller 82 which is rotatably supported at a fixed position, and the lower side pressure roller 83 which is spring-forced and pressure-contacts with the heat roller 82, and the toner image "t" is fixed.

As another embodiment of the pressure roller 83, in the same manner as the layer structural view of the heat roller 82 in FIG. 3, the resilient layer 832 is covered on the heat conductive substrate 831, and further thereon, the composite layer 834 formed of the rubber and resin is laminated and further thereon, the resin layer 835 is laminated, and the pressure roller 83 having 4 layer structure is formed. Fixing by polymerization toner:

Recently, in accompanied by the requirement of enhancement of the image quality in a copier or printer to which the electrophotographic system is applied, the reduction of the toner particle diameter is advanced. This inclination is conspicuous in a digital machine, and a color machine. As the production method of the toner, conventionally, the pulverization method is a main method, however, in accompanied by the recent flow of the reduction of the particle diameter of the toner, the toner production by the polymerization method is remarked. Further, in the toner production method by the polymerization method, the polymerization toner produced by the emulsion polymerization association method has the following characteristic.

The shape control of a wide range from the undefined shape to the sphere is easy.

Because the particle distribution is very sharp, and the charged amount distribution is also sharp, the movement of the toner in the electrophotographic process is more uniform, and the improvement of the image quality is attained.

In the dot reproducibility, even in the case of the same particle diameter, the noise is decreased compared to the pulverized toner, and the character image reproducibility is also increased.

Because the fine powder amount is small, the contamination of the carrier by the toner, so-called the toner spent is small, and it is advantageous for the increase of the durability.

The polymerization toner is produced by the above polymerization method and the polymerization toner whose softening point is not higher than 125° C. is selected and used. In the full color digital machine shown in FIG. 1, the image output is actually conducted, and the toner image by the polymerization toner whose softening point is not higher than 125° C. is formed on the sheet P, and is fixing processed by the fixing apparatus, and the reproducibility of the dot and the image quality are confirmed.

In order to quantitatively review to what degree the increase of the reproducibility of the dot is viewed by the human eyes as the actual increase of the image quality, the image quality noise is reviewed. For the review of the image quality, several methods are proposed, however, the density variation is measured by the micro-densitometer, and analyzed.

When the polymerization toner whose particle diameter is decreased, and whose softening point is not higher than 125° C. is used, even in the case of the same particle diameter, the noise of the image is smaller compared to the pulverized toner, and by the reduction of the particle diameter, the noise of the image is further reduced. That is, the scattering in the peripheral portion of the character, the disturbance of the horizontal line, and granular appearance of the image are few, and the image close to the original one can be obtained.

The minute hardness (the surface hardness by the micro hardness meter) of the releasing layer 823 of the heat roller 82 is measured by the micro rubber hardness meter MD-1 type made by KOBUNSHI KEIKI Co. Ltd. The sensor portion of the micro rubber hardness meter pushes the pushing pointer provided on the top end portion of the cantilever structure spring plate to the surface of the tested material, and the displacement amount of the spring plate is detected by the detection portion, and it is appropriate for the hardness measurement of the small rubber member or the rubber sheet of 1–2 mm.

TABLE 1

| Surface hardness (heating rotating body) | Flaw generation (heating rotating body durability) | Image quality (single side image) |
|---|---|---|
| 41° | Poor | Good |
| 47° | Fair | Good |
| 55° | Good | Good |
| 59° | Good | Good |
| 63° | Good | Good |
| 70° | Good | Good |
| 75° | Good | Good |
| 81° | Good | Fair |
| 84° | Good | Fair |

TABLE 2

| Surface hardness (pressure rotating body) | Flaw generation (pressure rotating body durability) | Double side image quality (first surface image) |
|---|---|---|
| 41° | Poor | Good |
| 47° | Fair | Good |
| 55° | Good | Good |
| 59° | Good | Good |
| 63° | Good | Good |
| 70° | Good | Good |
| 75° | Good | Good |
| 81° | Good | Poor |
| 84° | Good | Poor |

Table 1 shows the correlation of the fine hardness (micro hardness) of the releasing layer 823 of the heat roller 82, and the flaw generation and the image quality.

In the table, "good" in the column of the flaw generation shows that there is no generation of the flaw of the releasing layer 823 and the durability is excellent. "Fair" shows that the flaw generation is few, and "poor" shows that the flaw generation is considerably many. In the column of the image quality, "good" shows the high quality in which the scattering on the peripheral portion of the character, the disturbance of the horizontal line, and the granular appearance of the image are few, and "fair" shows the image quality in which these image quality deteriorations are slightly recognized.

As shown in Table 1, when the fine hardness of the releasing layer 823 of the heat roller 82 is set to not smaller than 55°, the image deterioration is few, and the flaw by the sheet separation claw is hardly received, and the durability is secured. Further, in the fixing apparatus provided with the contact type temperature detection sensor, it is effective for the prevention of the flaw generation on the releasing layer 823 by the contact type temperature sensor, and the prevention of the surface damage of the contact type temperature detection sensor. In this connection, in the case of less than 55° of the fine hardness, the generation of the flaw of the releasing layer 823 is remarkable.

When the fine hardness of the releasing layer 823 of the heat roller 82 is set to not larger than 75°, the pressure-contact of the releasing layer 823 with the sheet P and the follow-up property can be made good, and the image quality can be improved. Further, when the fine hardness of the releasing layer 823 is larger than 75°, the image quality becomes worse.

As the condition to satisfy both characteristics of the damage prevention of the releasing layer surface and the follow-up property to the sheet P described above, when the fine hardness of the releasing layer is set to not smaller than 55°, and not larger than 75°, the high image quality is maintained, and the print processing of 100 thousands sheets can be attained.

The table 2 shows the relationship of the fine hardness of the releasing layer 833 of the pressure roller 83, the generation of the flaws on the surface of the pressure roller, and the image quality of the first surface at the time of double side copying. The relationship of the fine hardness of the releasing layer 833 of the pressure roller 83, and the flaws on the surface of the pressure roller has the same inclination as in the case of the heat roller in the Table 1. Further, also the relationship of the image quality of the first surface at the time of the double side copying and the fine hardness of the releasing layer of the pressure roller has the same inclination as in the case of the heat roller (Table 1), however, when the fine hardness is not lower than 80°, the disturbance of the toner image is remarkable, and the image quality of the double sides is suddenly lowered. From the above description, as the condition in which the damage on the releasing layer surface of the pressure roller is prevented, and the follow-up property to the sheet is secured, and the double side image quality is not made poor, it is preferable that the fine hardness of the releasing layer 833 is set to not smaller than 55° and not larger than 75°.

Figure 4:
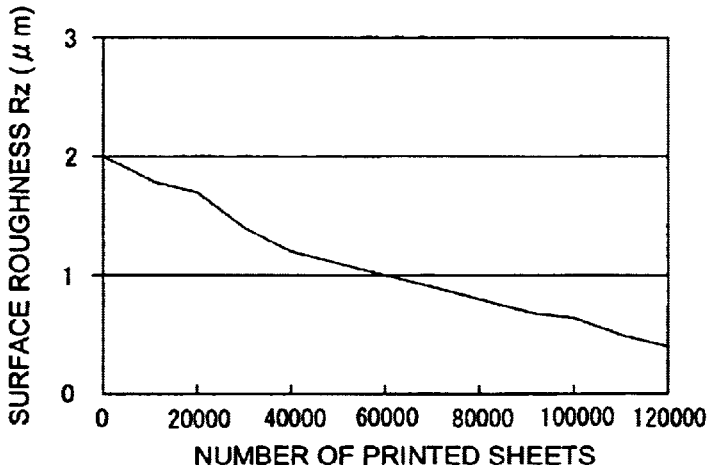
FIG. 4 is a characteristic view showing the transition of the surface roughness of a releasing layer to a number of printed sheets.

FIG. 4 is a characteristic view showing the transition of the surface roughness Rz of the releasing layer 823 to the printed number of sheets. As the increase of the printed number of sheets to be processed by the fixing apparatus, the surface roughness Rz of the releasing layer is lowered.

Figure 5:
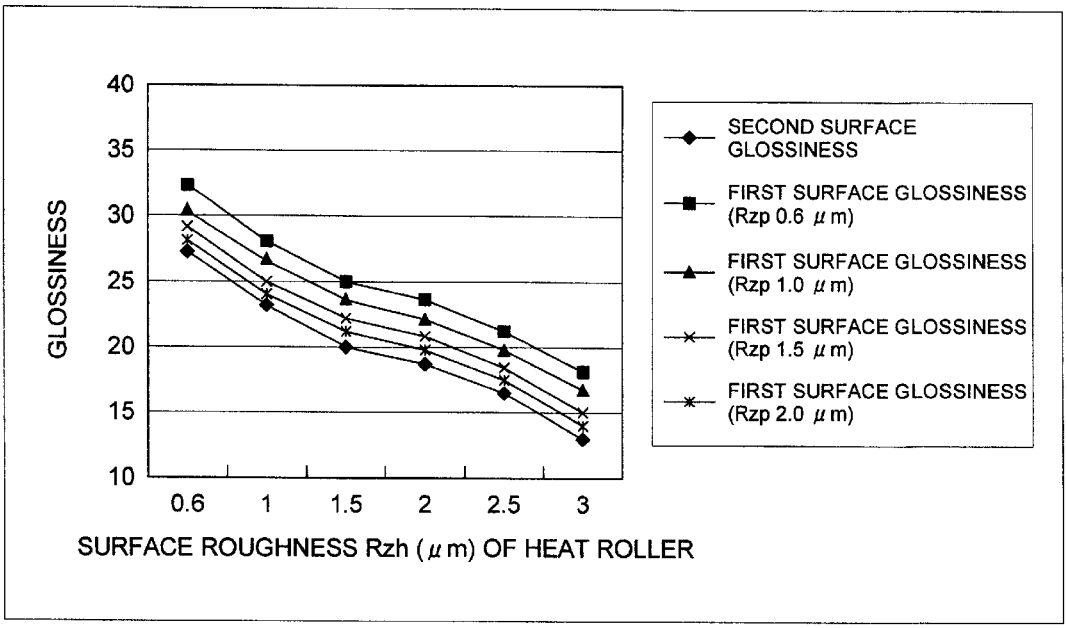
FIG. 5 is a characteristic view showing a relationship between the surface roughness of the releasing layer and the glossiness of a toner image formed on a sheet.

FIG. 5 is a characteristic view showing the relationship of the surface roughness Rzh of the releasing layer 823 of the heat roller 82 and the surface roughness Rzp of the releasing layer 833 of the pressure roller 83 and the glossiness of the toner images formed on the first and the second surface of the sheet P. Herein, the first surface is the surface on which the image is formed at first in the double side image, and the second surface is the surface on which the image is formed later.

In the case of the color image, the existence or nonexistence of the gloss gives the large difference to one's eyes. Normally, when the gloss of the bed of the sheet coincides with the gloss of the image portion, it gives the more natural impression. However, in order to realize the high chromaticness image which is attractive, it is more desirable to provide the gloss onto the sheet. The intensity of the gloss (glossiness) G is normally expressed by the specular gloss.

$$G=(Ip/Is)$$

Herein, Ip is the regular reflection light amount of the image, and Is is the regular reflection light amount of the reference surface, and normally used in the specular gloss of the incident angle of 60°.

The measurement of the glossiness is carried out by using the glossiness meter VGS-300A made by the NIHON DENSHOKU Co. according to the method 3 of JIS-Z8741.

When the surface roughness Rz of the releasing layer 823 is less than 0.5 μm, the glossiness G exceeds 30, and the gloss of the image portion of the sheet P is too strong, and the difference from the gloss of the bed of the sheet is large, and the feeling of strangeness is generated to human's eyes. When the surface roughness Rz of the releasing layer 823 exceeds 2.0 μm, the glossiness G of the image portion of the sheet P becomes lower then 20, and the attractive high chromatic image can not be obtained. As the result described above, it is preferable that the surface roughness Rz of the releasing layer 823 of the heat roller 82 is not smaller than 0.5 μm, and not larger than 2.0 μm. Further, when the surface roughness Rzp of the releasing layer 833 of the pressure roller 83 is also not smaller than 0.5 μm, and not larger than 2.0 μm, the glossiness of the image of the first surface when the double side copying is carried out, can also be maintained between almost 20 and 30, and the fine image can be obtained.

Figure 6:
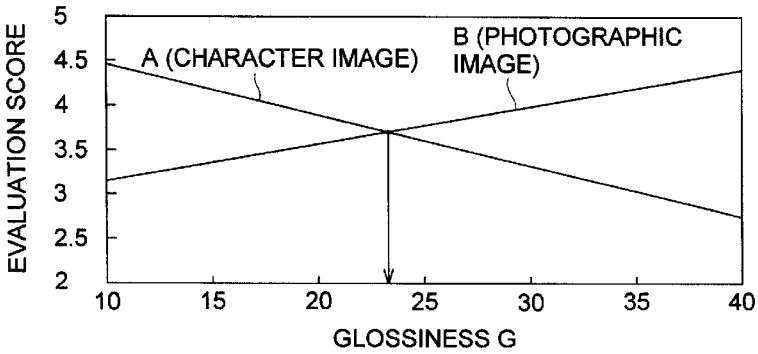
FIG. 6 is a characteristic view showing an evaluation of the glossiness of a character image and the glossiness of a photographic image.

FIG. 6 is a characteristic view showing the evaluation of the glossiness of the character image and the glossiness of the photographic image. The diagram A in the view shows the characteristic of the character image, and the diagram B shows the characteristic of the photographic image. The evaluation score is the glossiness organic function evaluation result of the five point scoring by the sensory evaluation.

In the characteristic of the character image, the evaluation score is higher as the glossiness G is lower, and when the glossiness G is higher, the evaluation score is lower. In the characteristic of the photographic image, specifically the color image, the higher the glossiness G is, the higher the evaluation score is, and when the glossiness is lower, the evaluation score is lower. The vicinity of the glossiness (about 23 of the glossiness in the view) at the position at which the diagram A of the character image and the diagram B of the photographic image are crossed, is the glossiness having both characteristics of the character image and the photographic image in parallel.

Resilient Layer of the Heat Roller:

It is preferable that the rubber hardness of the resilient layer 822 of the heat roller 82 is not larger than 20° according to the JIS-A regulation. As the hardness meter for the rubber, the type A of JIS-K6253 is most common. The hardness meter for the rubber pushes a predetermined-formed pushing pointer in the surface of the sample by the spring force and deforms it, and the pushing-in depth under the condition that the resistant force shown by the sample at the time and the spring force are balanced, is expressed as the hardness.

When the rubber hardness exceeds 20° of the predetermined value, the resilient layer 822 is too soft, and when the heat roller 82 and the pressure roller 83 are pressed by the predetermined pressing force, the fixing nip width is too long, and problems of the generation of the damage of the releasing layer 823, and the generation of the bleeding of the toner image are generated.

EXAMPLE

An example by the fixing apparatus of the present invention will be shown below.

Conveying speed of the sheet: 180 mm/sec

Layer structure of the heat roller: 3 layer structure composed of the heat conductive substrate, resilient layer, and releasing layer.

Hardness of the resilient layer of the heat roller: 10°.

The surface roughness Rz of the releasing layer of the heat roller: 1.5 μm.

Polymerization toner: styrene acrylic toner, the softening point is not higher than 125° C. Another example of the image forming apparatus:

The color image forming apparatus of the present invention is not limited to the tandem type color image forming apparatus shown in FIG. 1, but it can also be applied to the color image forming apparatus of the type in which the toner images "t" formed on a plurality of image carriers are directly transferred onto the sheet and the superimposed toner image is formed, and the superimposed toner image t is fixed by the fixing apparatus.

Further, the color image forming apparatus of the present invention can also be applied to the color image forming apparatus of the type in which, after each color toner image successively formed on image carriers is superimposed, the color image is formed by transferring at once onto the sheet by the transfer section, and then, the sheet P is peeled from the image carrier surface, and the superimposed toner image "t" is fixed by the fixing apparatus.

Following effects have been attained by the image forming apparatus provided with the fixing apparatus of the present invention.

(1) When the fine hardness of the releasing layer is set to not smaller than 55° and not larger than 75°, the image deterioration is small, the flaws are hardly received, the durability is secured, and while the high image quality is maintained, 100 thousand sheets print processing can be attained.

(2) When the polymerization toner whose diameter is reduced to small, and whose softening point is not higher than 125° C., is used, the noise is reduced, and the fixing image in which the scattering in the peripheral portion of the character, the disturbance of the horizontal line, and the granular appearance of the image are few, and which is close to the original one, can be obtained.

(3) When the surface roughness Rz of the releasing layer of the heat roller is set to not smaller than 0.5 μm, and to not larger than 2.0 μm, the image which is set to the optimum condition of the glossiness of the character image and the glossiness of the photographic image, can be formed.

(4) When the surface roughness Rz of the releasing layer of the pressure roller is set to not smaller than 0.5 μm. and to not larger than 2.0 μm, the double side images with the desirable glossiness can be obtained.

(5) When the rubber hardness of the resilient layer of the heat roller is set to not larger than 20° according to JIS-A regulation, problems of the generation of the damage of the releasing layer and the generation of the bleeding of the toner image can be solved.

(6) The stabilization of the glossiness and the image quality level, and the increase of the durability can be attained by the fixing apparatus provided with the heat roller and the pressure roller of the present invention, and the polymerization toner. Specially, in the color image forming apparatus, the high image quality can be obtained.

What is claimed is:

1. A fixing apparatus for fixing a toner image formed on a transfer sheet comprising:

a rotatable heating member comprised of a first thermo-conductive base material, a first heat-resistive resilient layer disposed over the outer surface of the first thermo-conductive base material, and a first heat-resistive releasing layer disposed over the first heat resistive resilient layer;

a heat source provided at the interior of the first thermo-conductive base material to heat the rotatable heating member; and a rotatable pressure member to nip and transport the transfer sheet between the rotatable pressure member and the rotatable heating member, comprised of a second thermo-conductive base material, a second heat-resistive resilient layer disposed over the outer surface of the second thermo-conductive base material and a second heat-resistive releasing layer disposed over the second heat-resistive resilient layer;

wherein, hardness of each of the surface of the first and the second heat-resistive releasing layers measured by a micro hardness meter is 55 to 75°, and surface roughness Rz of each of the surface of the first and the second heat-resistive releasing layers is 0.5 to 2.0 $\mu$m.

2. The fixing apparatus of claim 1, wherein the first heat-resistive resilient layer comprises a filler.

3. The fixing apparatus of claim 2, wherein the filler is metallic oxide.

4. The fixing apparatus of claim 3, wherein the amount of metallic oxide is 5–30 weight %.

5. The fixing apparatus of claim 4, wherein the first heat-resistive resilient layer has heat conductivity of 0.2–2 W/m·K, has thickness of 0.8–5 mm, and comprises a silicone rubber or a fluorine rubber, and the first heat-resistive releasing layer has heat conductivity of 0.3–1 W/m·K.

6. The fixing apparatus of claim 1, wherein the first heat-resistive resilient layer has thickness 0.8–5 mm.

7. The fixing apparatus of claim 1, wherein the first heat-resistive releasing layer comprises a fluorine resin, a silicon rubber or a fluorine rubber.

8. The fixing apparatus of claim 7, wherein the heat-resistive releasing layer has heat conductivity of 0.3–1 W/m·K.

9. An image forming apparatus comprising:

a photoreceptor to form an electrostatic latent image;

a developing device to develop the electrostatic latent image and to form a toner image on the photoreceptor by applying a toner made by a polymerizing process, wherein the softening point of the toner is not higher than 125° C.;

a transfer section to transfer the toner image from the photoreceptor to a transfer sheet;

a fixing apparatus for fixing the toner image on a transfer sheet comprising: a rotatable heating member comprised of a first thermo-conductive base material, a first heat-resistive resilient layer disposed over the outer surface of the first thermo-conductive base material, and a first heat-resistive releasing layer disposed over the first heat resistive resilient layer; a heat source provided at the interior of the first thermo-conductive base material to heat the rotatable heating member; and a rotatable pressure member to nip and transport the transfer sheet between the rotatable pressure member and the rotatable heating member, comprised of a second thermo-conductive base material, a second heat-resistive resilient layer disposed over the outer surface of the second thermo-conductive base material and a second heat-resistive releasing layer disposed over the second heat-resistive resilient layer;

transfer sheet reversing means to form toner images on both sides of the transfer sheet;

wherein, hardness of the surface of each of the first and the second heat-resistive releasing layers measured by a micro hardness meter is 55 to 75°, and surface roughness Rz of each of the surfaces of the first and the second heat-resistive releasing layers is 0.5 to 2.0 $\mu$m.

10. The image forming apparatus of claim 9, wherein the first heat-resistive resilient layer comprises a filler.

11. The image forming apparatus of claim 10, wherein the filler is a metallic oxide.

12. The image forming apparatus of claim 10, wherein the amount of the metallic oxide is 5–30 weight %.

13. The fixing apparatus of claim 12, wherein the first heat resistive resilient layer has heat conductivity of 0.2–2 W/m·K, has thickness 0.8–5 mm, and comprises a silicone rubber or a fluorine rubber, and the first heat-resistive releasing layer has heat conductivity of 0.3–1 W/m·K.

14. The image forming apparatus of claim 9, wherein the first heat-resistive resilient layer has heat conductivity of 0.2–2 W/m·K.

15. The image forming apparatus of claim 9, wherein the first heat-resistive releasing layer comprises a fluorine resin, a silicon rubber or a fluorine rubber.

16. The image forming apparatus of claim 15, wherein the first heat-resistive releasing layer has heat conductivity of 0.3–1 W/m·K.

17. The image forming apparatus of the first claim 9, wherein the first heat-resistive resilient layer has thickness 0.8–5 mm.

18. A fixing apparatus for fixing a toner image formed on a transfer sheet comprising:

a rotatable heating member comprised of a thermo-conductive base material, a heat-resistive resilient layer over the thermo-conductive base material, and a heat-resistive releasing layer disposed over the heat-resistive resilient layer;

a heat source to heat the rotatable heating member; and a rotatable pressure member to nip and transport the transfer sheet between the rotatable pressure member and the rotatable heating member;

wherein hardness of the surface of the heat-resistive releasing layer measured by a micro hardness meter is 55 to 75°, and surface roughness Rz of the surface of the heat-resistive releasing layers is 0.5 to 2.0 $\mu$m.

19. The fixing apparatus of claim 18, wherein the heat-resistive releasing layer is an outermost layer included in the rotatable heating member.

* * * * *

UNITED STATES PATENT AND TRADEMARK OFFICE

CERTIFICATE OF CORRECTION

PATENT NO. : 6,690,906 B2
DATED : February 10, 2004
INVENTOR(S) : Tanaka et al.

It is certified that error appears in the above-identified patent and that said Letters Patent is hereby corrected as shown below:

Title page,
Item [73], Assignee, change to read -- Konica Corporation, Tokyo, Japan. --

Signed and Sealed this

Twenty-fourth Day of May, 2005

JON W. DUDAS
*Director of the United States Patent and Trademark Office*